US005846169A

United States Patent [19]

Tscheschlog

[11] Patent Number: 5,846,169

[45] Date of Patent: Dec. 8, 1998

[54] SQUATTING HARNESS

[76] Inventor: Robert Tscheschlog, 347 E. Butler Ave., New Britain, Pa. 18901

[21] Appl. No.: 23,042

[22] Filed: Feb. 13, 1998

[51] Int. Cl.[6] ..... A63B 21/06

[52] U.S. Cl. ..... 482/105; 224/265

[58] Field of Search ..... 482/93, 105, 106; 224/201, 265, 266, 634, 637, 631, 632

[56] References Cited

U.S. PATENT DOCUMENTS 3,679,107 7/1972 Perrine ..... 482/105

5,118,100 6/1992 Sungaila ..... 482/105

5,299,999 4/1994 Brine ..... 482/105

*Primary Examiner*—John Mulcahy

*Attorney, Agent, or Firm*—Zachary T. Wobbnsmith, III

[57] ABSTRACT

A squatting harness for use by a person when lifting a barbell includes: a belt to engage a user's waist, a lower shank extending upward from the belt, an upper shank connected to the lower shank so as to allow adjustment of the relative angular position and effective length of the upper and lower shanks, a bar rest bracket on the upper shank to engage the bar of the barbell, and a pair of hooks connected to the upper shank for engaging the user's shoulders whereby the lifted weight may be carried by the user's shoulders and hips.

6 Claims, 4 Drawing Sheets

SQUATTING HARNESS

BACKGROUND OF THE INVENTION

1. Field of the Invention

This invention relates to a squatting harness intended to be worn by weight lifters, of the type which shifts a portion of the weight from the users upper body and spine to the hips.

2. Description of the Prior Art

It has long been the goal of persons who lift weights that straining of the upper spine and shoulders must be minimized in order to reduce the likelihood of serious damage to the user. It has been recognized that it would be desirable to be able to shift or transfer a large portion of the weight lifted to the users hips to reduce pressure on the spine and shoulder. Various solutions to this problem have been advanced such as those illustrated in the U.S. Pat. Nos. 744,477; 3,679,107; 4,213,605; 4,438,763; 4,722,524; 5,148,549; 5,342,272; 5,183,194; and 5,388,274, but none of them is entirely satisfactory.

The apparatus of the invention is adjustable to shift a desired portion of the weight to the users hips, and to maintain contact with the users upper torso while protecting the spine and vertebrae.

SUMMARY OF THE INVENTION

This invention relates to a squatting harness which includes a reinforced belt to encircle the waist of a user, a lower upright shank carried by the belt which includes holes for adjustment and angular variance, an upper shank which is engaged by the lower shank, the upper shank having a shoulder, neck rest, and a weight bar rest bracket extending therefrom, which shoulder neck rest engages the shoulder of the user dividing the lifted weight between the shoulders and hips.

The principal object of the invention is to provide a squatting harness for weight lifters which divides the lifted weight between the users shoulders and hips.

A further object of the invention is to provide a squatting harness which is easy to use.

A further object of the invention is to provide a squatting harness that can be adjusted to accommodate a variety of users requirements.

A further object of the invention is to provide a squatting harness that is provided with stress relief padding.

A further object of the invention is to provide a squatting harness that is sturdy and reliable in use.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
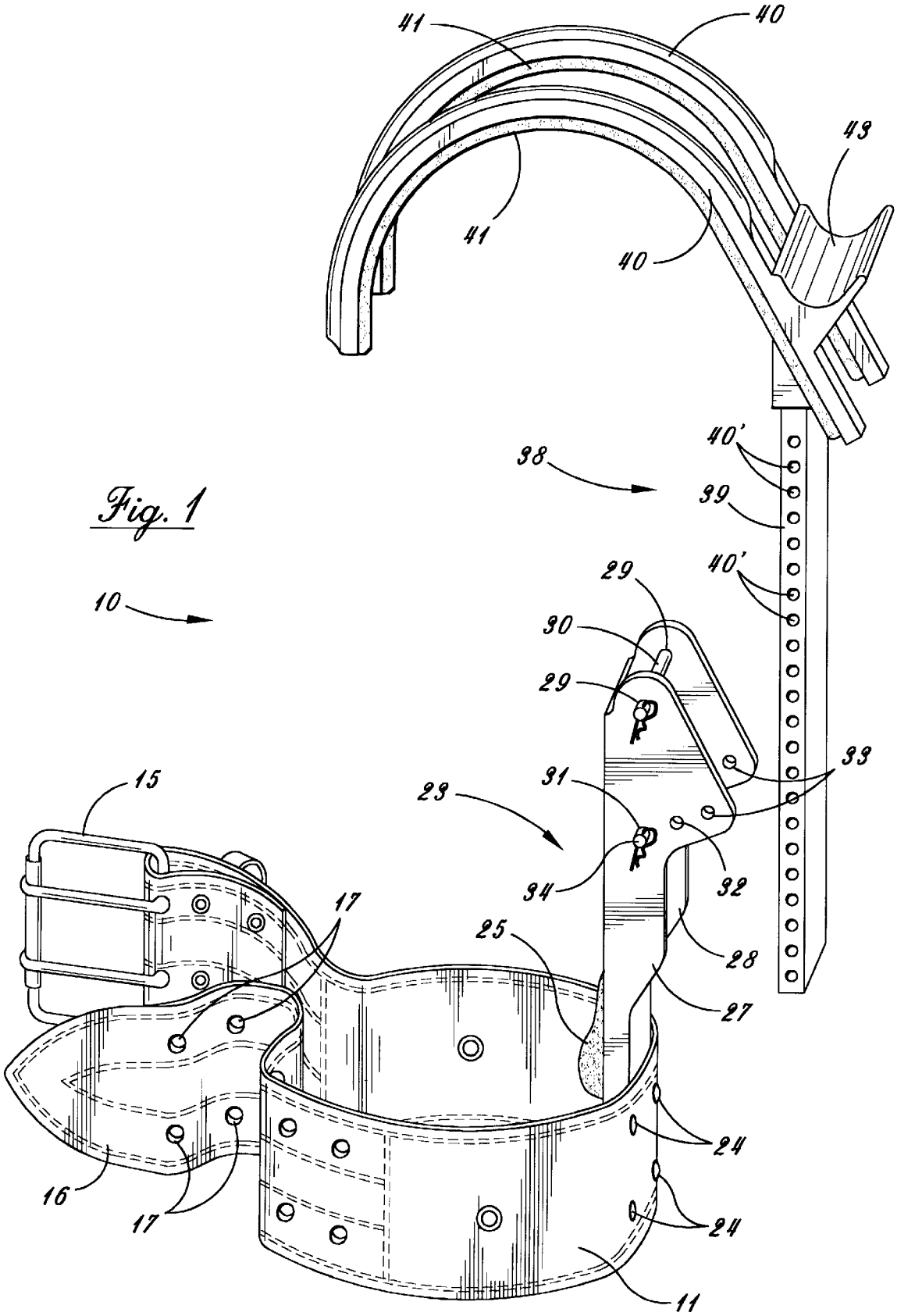
FIG. 1 is a side elevational view of one embodiment of the squatting harness of the invention.
Figure 2:
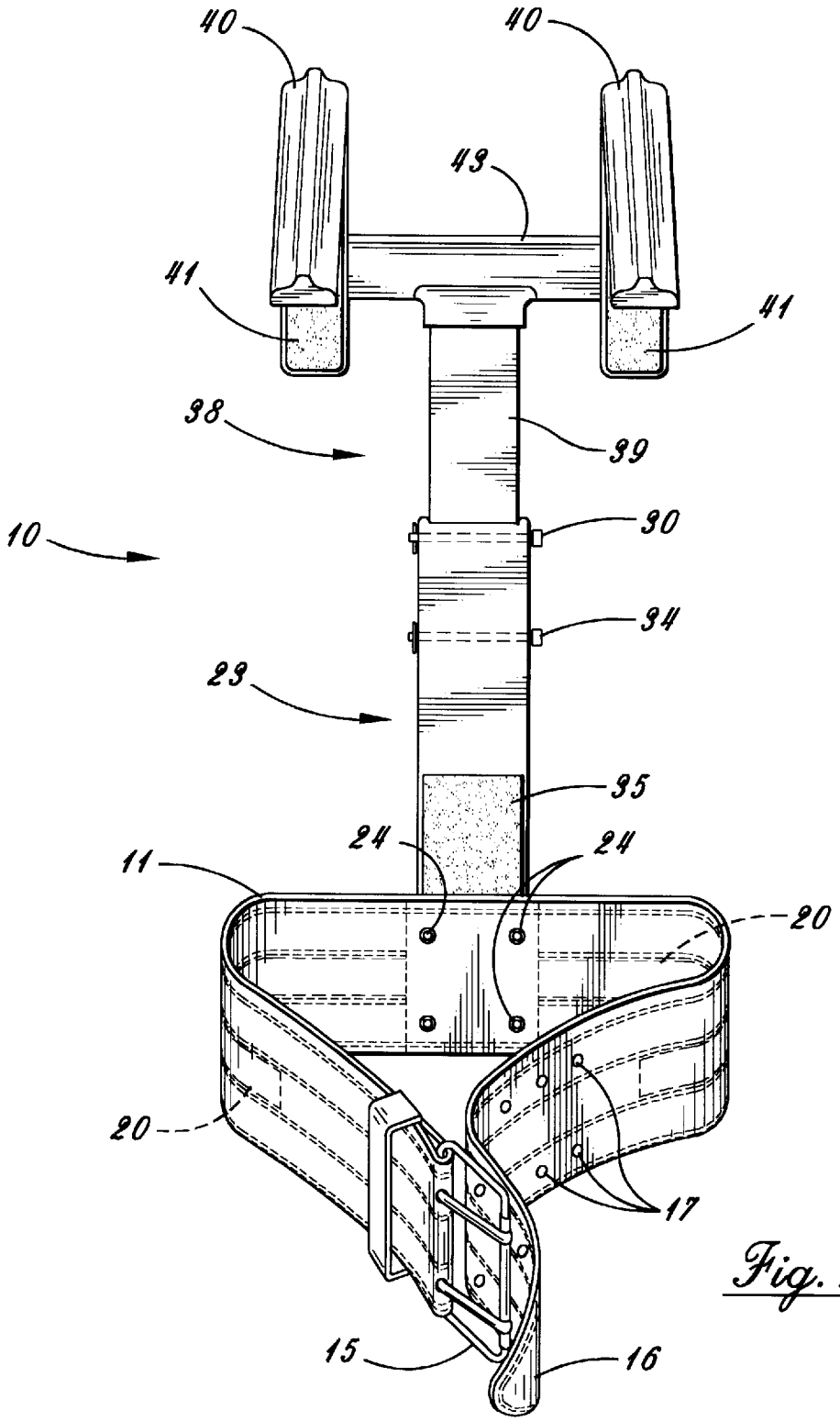
FIG. 2 is a rear elevational view of the harness of FIG. 1.
Figure 3:
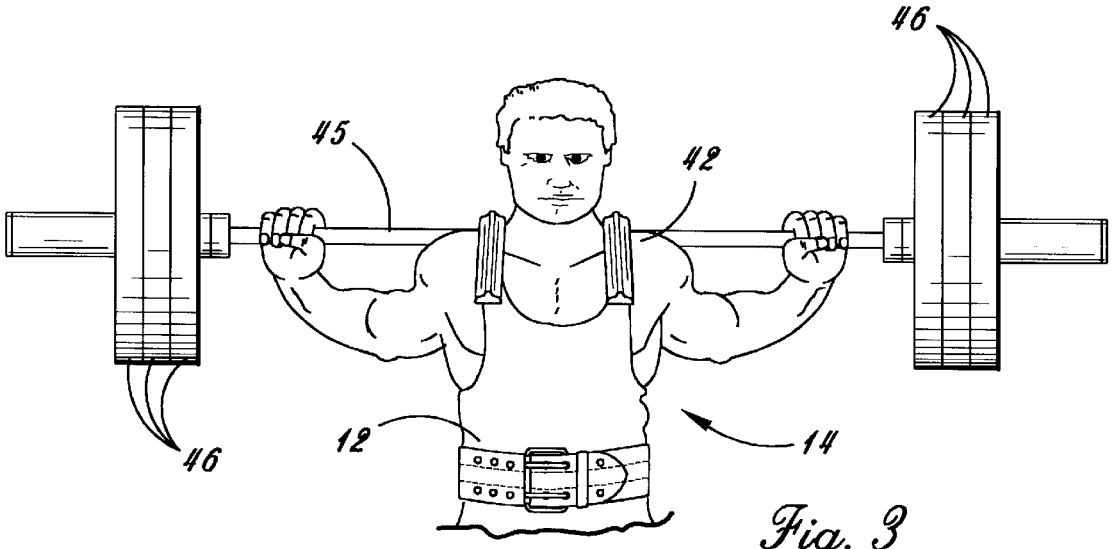
FIG. 3 is a front view of the apparatus of FIG. 1 in place on a user.
Figure 4:
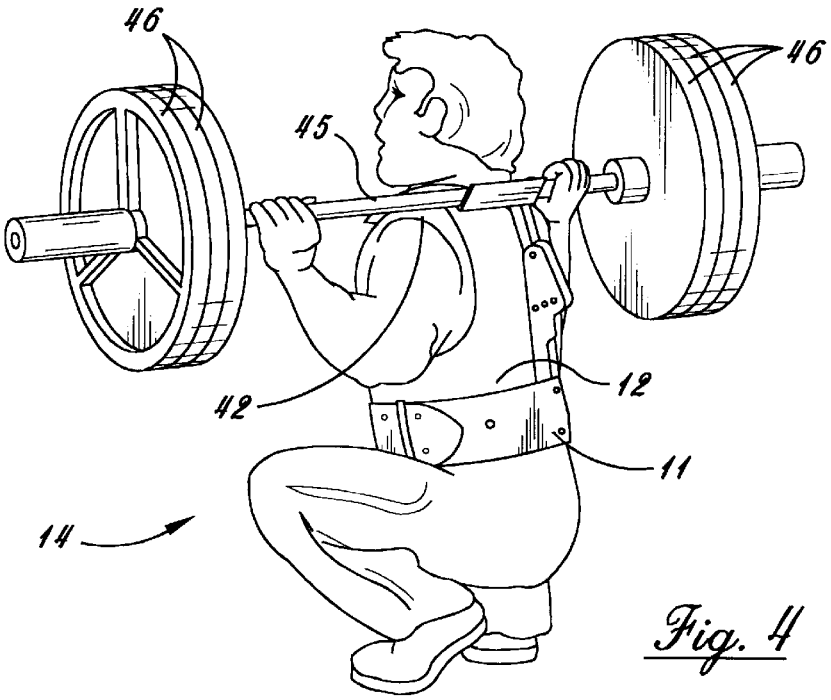
FIG. 4 is a rear view of the user of FIG. 3.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1 through 4 of the drawings, one embodiment of the squatting harness 10 is therein illustrated.

The harness 10 includes a leather belt 11, which is intended to encircle the waist 12 of a user 14.

The belt 11 has a buckle 15, and an end 16 with holes 17, which end is intended to engage the buckle 15.

While the belt 11 length will vary according to the users requirements, it has been found that a belt of ½ inch thickness, with a width of 4 inches, and a length of 43 inches is satisfactory for many users.

The belt 11 which is of two layer sewn construction is also provided with a reinforcing steel inlay 20 between the belt layers. The steel inlay 20 extends substantially around the rear and sides of the user 14.

A lower shank 23 is provided which extends vertically upwardly from the belt 11 as shown in the FIGS., and is retained thereto by rivets 24.

The lower shank 23 is formed of steel with a u-shaped rearwardly extending channel which comprises plates 27 and 28 extending therealong, with each of them having holes 29 therein, which receive a pin 30 to be described.

The plates 27 and 28 are each also provided with holes 31, 32 and 33 which are selectively engaged by a pin 34 to be described.

The lower shank 23 may also be provided with a lower lumbar pad 35 to engage the user and assist the harness in maintaining tight contour with the spinal curvature of the user 14.

An upper shank 38 is provided, which includes a vertical bar 39, with a plurality of transversbly extending spaced holes 40 therein which are intended to be engaged by pins 30 and 34.

The upper shank 38 has a pair of curved hooks 40 extending therefrom which have pads 41 thereunder which are intended to engage the shoulders 42 of the user 14.

The hooks 40 have a bar rest bracket 43 connecting them, which is connected to the bar 39, and is intended to have the bar 45 of a weight set engaged therewith in resting position, which bar 45 has a plurality of weights 46 thereon.

The pins 30 and 34 are respectively placed in holes 29, 31, 32 or 33 of plates 27 and 28, and selected holes 40 of upper shank 38, to provide the desired angle and height of the hooks 40 for the users requirements.

Figure 5:
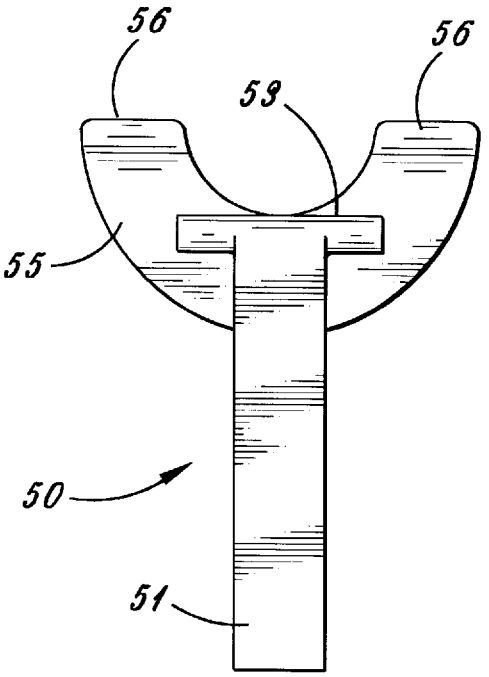
FIG. 5 is a rear view of another embodiment of the shoulder, neck rest, bar, hook portion of the harness of the invention.
Figure 6:
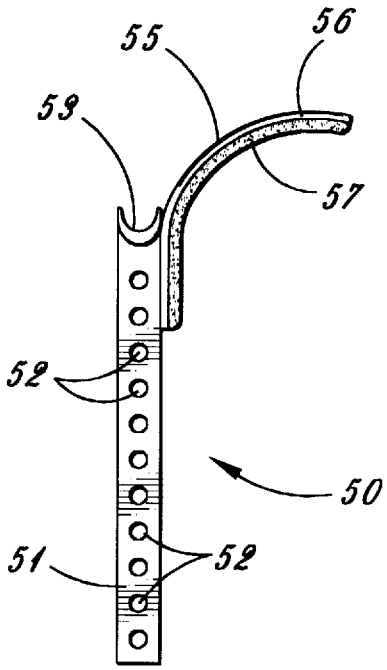
FIG. 6 is a side elevational view of the embodiment illustrated in FIG. 5.
Figure 7:
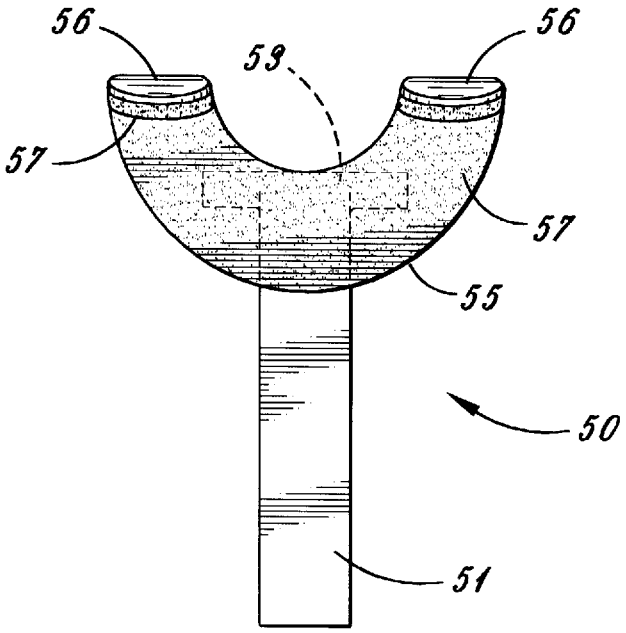
FIG. 7 is a front elevational view of the embodiment illustrated in FIG. 5.

Referring additionally to FIGS. 5–7 another embodiment of upper shank 50 is therein illustrated.

The upper shank 50 includes a vertical bar 51 with a plurality of spaced holes 52 therein, to engage pins 30 and 34 as described above for upper shank 38.

The upper shank 50 includes a bar rest bracket 53 perpendicular to bar 51 to engage the weight set bar 45.

The bar 51 has a plate 55 fastened thereto, which is of oval configuration, with a pair of fowardly extending curved hooks 56 extending therefrom, with pads 57 thereon, which are intended to engage the shoulders 42 of the user 14 to divert a portion of the lifted weight to the users hips.

The mode of operation and use will now be pointed out.

When it is desired to use the squatting harness 10, belt 11 is secured about the waist 12 of the user 14.

The bar 39 or 51 is placed between the plates 27 and 28, and pins 30 and 34 are inserted in holes 31, or 32 or 33 through holes 40 or 52, and adjusted for proper angle and contact of pads 41, hooks 40, or pads 57, hooks 56 with the shoulders 42 of the user 41.

The weight bar 45 can be engaged with the bar rest bracket 43 or 53 and the user 14 commences the exercise.

It will thus be seen that apparatus has been provided with which the objects of the invention are achieved.

I claim:

1. In a squatting harness for use by a person when lifting a weight set which includes a bar and a plurality of weights, which acts to shift a portion of the lifted weight to a user's hips, the improvement which comprises:

a belt to engage a user's waist;

a lower shank extending upward from said belt;

an upper shank;

connecting means connecting said upper and lower shanks and allowing adjustment of the relative angular position and effective length of the upper and lower shanks;

a bar rest bracket on said upper shank to engage a weight set bar; and a pair of hooks connected to said upper shank and having cushioning means for engaging a user's shoulders;

whereby the lifted weight may be carried by a user's shoulders and hips.

2. A squatting harness as defined in claim 1 in which said belt is of leather with reinforcing means therein.

3. A squatting harness as defined in claim 1 in which said lower shank has a lumbar pad thereon to engage the a user's back.

4. A squatting harness as defined in claim 1 in which said upper shank includes a vertical bar with a plurality of transverse holes therein;

said lower shank has a U-shaped channel thereon with a pair of plates having spaced holes therein;

said connecting means is at least two pins which engage at least two of the holes in said plate and said bar for vertical adjustment and adjustment of angular relationship.

5. A squatting harness as defined in claim 1 in which said bar rest bracket is connected to said upper shank and to said pair of hooks.

6. A squatting harness as defined in claim 1 in which said bar rest bracket is connected to said upper shank;

said upper shank has an oval plate extending therefrom, and said hooks are connected to said plate.

* * * * *